United States Patent [19]

Nakanishi

[11] 4,086,681

[45] May 2, 1978

[54] DOOR CLOSER

[76] Inventor: Yoshitaka Nakanishi, 12-9, Yawata 5-chome, Ichikawa-shi, Chiba-ken, Japan

[21] Appl. No.: 742,356

[22] Filed: Nov. 16, 1976

[30] Foreign Application Priority Data

Jun. 22, 1976 Japan ..... 51-72828

[51] Int. Cl.[2] ..... E05F 3/00

[52] U.S. Cl. ..... 16/49; 16/82; 16/71

[58] Field of Search ..... 248/224.1, 224.2; 16/49, 71, 82, 137

[56] References Cited

U.S. PATENT DOCUMENTS

| | | | |
|---|---|---|---|
| 3,188,682 | 6/1965 | Check et al. | 16/49 |
| 3,252,178 | 5/1966 | Check et al. | 248/224.2 X |
| 3,787,924 | 1/1974 | Jentsch | 16/49 |

*Primary Examiner*—Ronald Feldbaum

*Attorney, Agent, or Firm*—Robert E. Burns; Emmanuel J. Lobato; Bruce L. Adams

[57] ABSTRACT

A door closer comprising a plate-shaped mounting bracket which is fixed to a door and has a pair of elongate tongue-shaped male coupling portions at both edges thereof, and a main body of the door closer which has a pair of elongate groove-shaped female coupling portions at the outer side face thereof, in which the female coupling portions is slidably fitted to the male coupling portions for connecting the main body to the mounting bracket.

6 Claims, 6 Drawing Figures

DOOR CLOSER

BACKGROUND OF THE INVENTION

This invention relates to a door closer, particularly to the structure for fixing a door closer to a door.

Heretofore, a door closer has been directly fixed to a door by means of screws, so that it was not easy to fix a heavy door closer onto a door, especially at its higher position.

It is an object of this invention to provide a door closer which may be fixed onto a door promptly and easily as well as secured with good appearance.

Another object of this invention is to provide a door closer which may be used in common for a left-handed or a right-handed door.

A further object of this invention is to provide a door closer which has good appearance, simple and strong fitting structure, assuring easy manufacture.

SUMMARY OF THE INVENTION

To attain above mentioned objects, the door closer according to this invention is provided with a mounting bracket to be fixed to the door, having a pair of elongate tongue-shaped male coupling portions, and a main body having a pair of elongate groove-shaped female coupling portions fitted to the male coupling portions, and the door closer is connected with the mounting bracket by the fitting of the male coupling portions in the female coupling portions.

BRIEF DESCRIPTION OF THE DRAWINGS

These and other objects as well as characteristics of this invention will be apparent to persons skilled in the art from the study of the following description with reference to the accompanying drawings, in which:

As shown in FIGS. 1 and 4, a main body 2 of a door closer 1 according to this invention is fixed to an upper part of a door 3 through a mounting bracket 4. Within the main body 2 of the door closer, known mechanism (not shown) is included, which performs the door closing and controls the door closing speed. As the door closing mechanism, general springs (not shown) are suitably used, and as the controlling mechanism for the door closing speed, generally the combination of a movable piston (not shown) and oil pressure means (not shown) for controlling the movement of said piston are suitably used.

Figure 1:
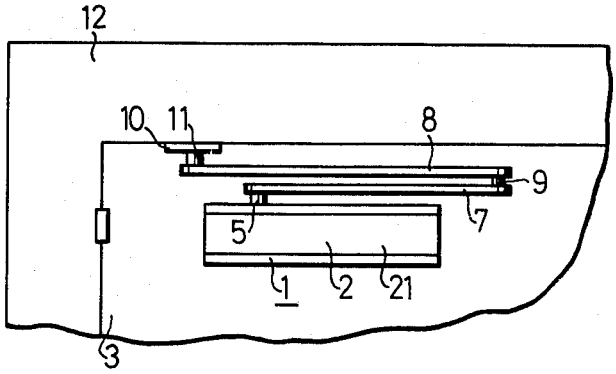
FIG. 1 is an elevational view of the new door closer fixed to a door, a part of the door and the door frame being omitted.

A driving shaft 5 projects upwardly from an upper wall 6 of the main body of the door closer and one end of an arm 7 is fixed to the driving shaft. Another end of the arm 7 is pivoted on one end of another arm 8 by a pin 9, another end of the arm 8 is pivoted on a bracket 10 by a pin 11, and the bracket 10 is connected to a stationary door frame 12. Manually opened door 3 will be closed with desirable speed by the driving force of the driving shaft 5 through the arms 7 and 8.

Figure 2:
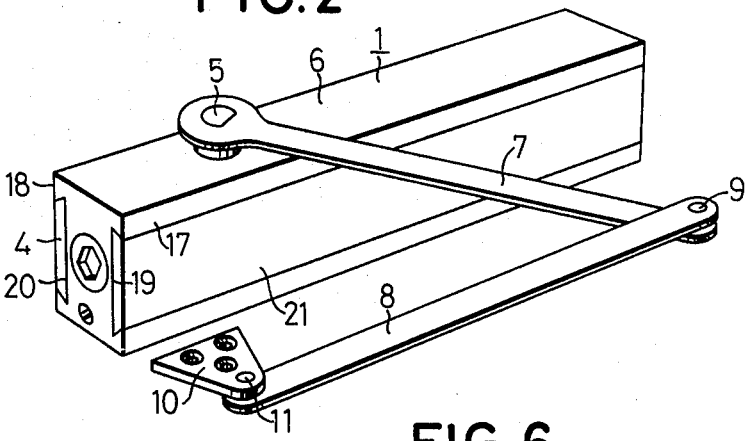
FIG. 2 is a perspective view of the door closer according to this invention.
Figure 3:
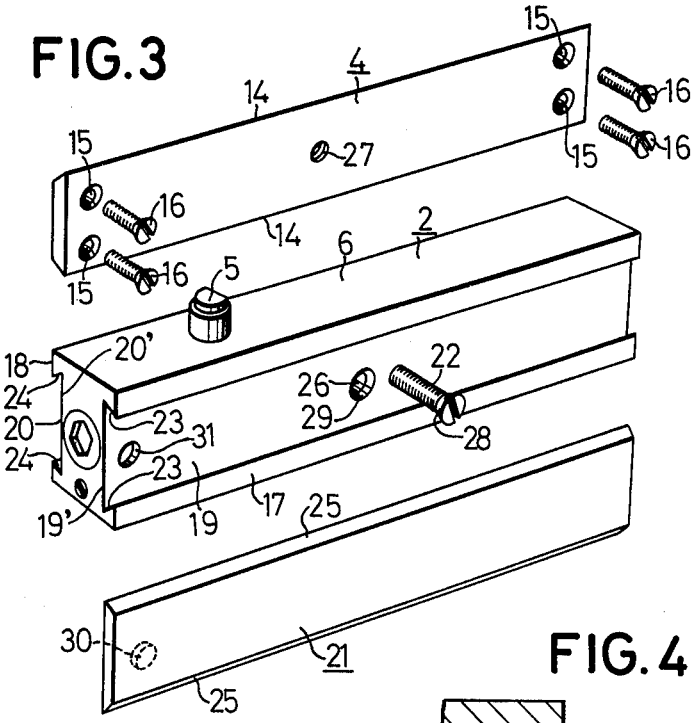
FIG. 3 is an exploded perspective view of the door closer.

As shown in FIG. 2 and FIG. 3, the mounting bracket 4 is formed by an elongated rectangular plate of rectangular outline and generally rectangular cross-section, as shown. The cross-section has a pair of long tongue-shaped male coupling portions or projectins 14 each coextensively extending, as shown, along one of its longitudinal upper and lower edges. These projections accordingly are mutually parallel, and extend horizontally. The bracket is fixed to the door 3 by screws 16 passing through holes 15 in the mounting bracket.

The door closer main body 2 is formed by an elongated rectangular parallelepiped, as shown in FIG. 2 and FIG. 3, and has mutually parallel, elongate walls shown as front wall 17 and rear wall 18. Each of and these walls is provided with a groove-shaped, undercut female coupling portion or recess 19 and 20 each parallel to the other, each coextensively extending, as shown along one of the walls 17, 18 and being, accordingly, elongated in the horizontal direction. Into the female coupling portion 20 of the rear wall 18 of the main body 2, the male coupling portion 14 of the mounting bracket 4 is inserted to connect the mounting bracket and the main body mutually, and into the female coupling portion 19 of the front wall 17, a male coupling portion 25 of a rectangular covering plate 21 is inserted to connect the covering plate with the main body. Both of the female coupling portions 19, 20 are of the same shape and size, and the male coupling portions 14 and 25 of the mounting bracket 4 and of the covering plate 21 may be inserted into either of the female coupling portions 19 and 20. As also shown, both of the female coupling portions 19 and 20 are arranged symmetrically with respect to the vertical central plane of the main body 2.

Therefore, in case of the door 3 being left-handed, as shown, the male coupling portion 14 of the mounting bracket 4 is inserted into the female coupling portion 20 and the male coupling portion 25 of the covering plate 21 into the female coupling portion 19; but it will be understood that, in case of the door 3 being right-handed, the male coupling portion 14 of the mounting bracket 4 is inserted into the female coupling portion 19 and the male coupling portion 25 of the covering plate 21 into the female coupling portion 20. Thus, by selectively inserting the male coupling portions 14 and 25 of the mounting bracket and the covering plate into the female coupling portions 19 and 20, the same door closer may be fixed selectively to a left-handed or right-handed door, and the top wall 6 of main body 2 of the closer is always located at the upper position, that is the main body need not be reversed as to its top and bottom. Thus the structure of the door closer is simple and compact.

Since the light and handy mounting bracket 4 is fixed to the door by screws and then the closer is fixed to the door by slidably engaging the female coupling portion 19 or 20 of the closer main body 2 with the male coupling portion 14 of the mounting bracket 4, the mounting operation thereof may be effected easily and promptly. When the closer is fixed to the door, fixing screws 16 for the mounting bracket are held down by the bottom of female coupling portion 19 or 20 of the main body 2, so that the screws will never become loose. The fixing of the closer is favorably maintained and has good appearance, the screws being invisible from outside.

Figure 4:
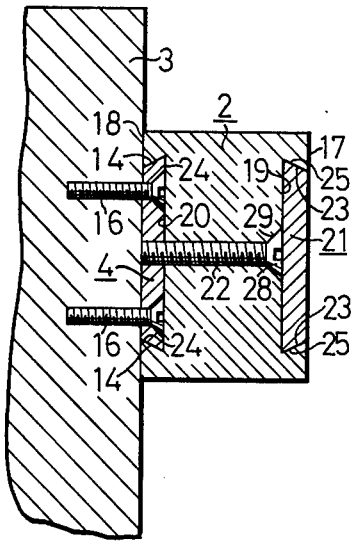
FIG. 4 is a transverse sectional view of the door closer fixed to the door.

In order to slidably engage the male coupling portions 14 and 25 of the mounting bracket 4 and the covering plate 21 with the female coupling portions 19 and 20 of the main body of the closer, each of the female coupling portions 19 and 20 is undercut by having a pair of confronting inner wall faces 23 or 24 forming a dovetail groove as shown in FIG. 4, and these inner wall faces 23 or 24 are mutually parallel extending in the horizontal direction as well as inclined so as to decrease the spacing between inner wall faces 23 or 24 as these faces advance towards the opening face of the groove. Also, the mounting bracket 4 and the covering plate 21 have substantially equal sectional shape to those of grooves 19' and 20'. Each of the male coupling portions 14 and the male coupling portions 25 of upper and lower edge portions of both plate 4 and 21 is mutually parallel extending in the horizontal direction and inclined so as to engage with the inner wall faces 23 and 24. The dimensions of thickness of the mounting bracket 4 and those of depth of grooves 19' and 20' of the main body 2 are substantially equal, and when the main body 2 is fixed to the wall face of door 3 through the mounting bracket 4, the rear face 18 of the main body contacts with the wall face of the door to hide the mounting bracket 4, thereby the closer is fixed with good appearance.

The male coupling portions 14 of the mounting bracket 4 and the female coupling portion 19 or 20 of the main body 2 are merely engaged relatively to allow relative sliding of both of the portions. The sliding between these portions 14 and 19 or 20 is prevented by inserting a screw 22 into a through hole 26 of the main body 2 and by screwing it into a screw hole 27 of the mounting bracket 4. To keep a head 28 of the screw 22 not to protrude outside from the bottom face of the groove 19' or 20', for instance, the head is formed as a flush head, and a bottom face 29 is formed conically to receive the flush head. Since the head 28 of the screw is held down by the covering plate 21, looseness of the screw 22 is prevented, and since the covering plate covers the groove 19' or 20', the head of fixing screw 22 and the groove are hidden to keep the appearance of front face of the main body good. The covering plate 21 may be colored and patterned in various manners, and by using this covering plate, the front face of the door closer may be made colorful and beautiful. The covering plate may be made of metal, preferably it is formed by synthetic resin to facilitate the decoration of the covering plate. Further, relative sliding between the covering plate 21 and the groove 19' or 20' of the main body 2 may be prevented by tight fitting of the covering plate 21 in the groove 19' or 20' of the main body, but it may be more strongly prevented by fitting a projected portion 30 provided on the rear face of the covering plate into a recess or indentation 31 provided on the bottom face of the groove 19' or 20'.

Figure 5:
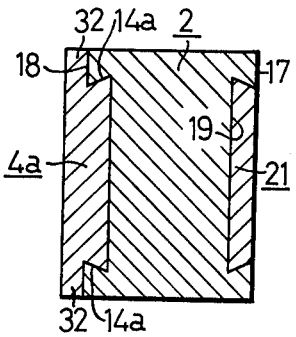
FIG. 5 is a transverse sectional view of a modified door closer.

The mounting bracket 4 may be modified as shown in FIG. 5. The modified mounting bracket **4*a* has flages 32 which extends upward and downward from ends of inclined male coupling portion 14*a*, with which flanges 32 the rear face 18 or front face 17 of the main body 2 contacts. The mutually contacting faces of the mounting bracket 4*a* and the main body 2 are more easily and exactly formed than the corresponding faces of the door 3 and the main body 2**.

Figure 6:
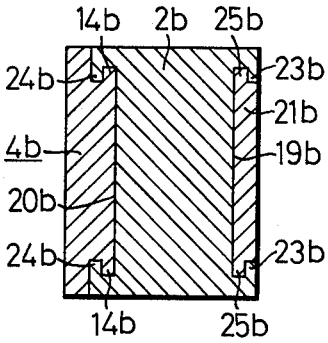
FIG. 6 is a transverse sectional view of another modified door closer.

In FIG. 6, there is shown a further modified coupling portion of a mounting bracket **4*b*, a covering plate 21*b* and a main body 2*b*. The mounting bracket 4*b* and the covering plate 21*b* have T-shaped male coupling portions 14*b* and 25*b* extending upward and downward from side faces thereof. A female coupling portion 19*b*, 20*b* of the main body has a T-grooved shape having extended portions 23*b* and 24*b* extending from opening edges in confronting direction. Between the extended portions 23*b* and 24*b* and the bottom of grooves, tongue-shaped male coupling portions 14*b* and 25*b*** of the mounting bracket and the covering plate are fitted to connect with each other.

It is to be understood that the present invention is not limited to the above mentioned embodiment thereof, but may be otherwise variously modified within the scope of the following claims.

What is claimed is:

1. A door closer, comprising; a plate-shaped mounting bracket of generally rectangular cross-section and rectangular outline, which in use is fixed to a door, the bracket having two tongue-shaped coupling portions projecting from said cross-section and which, when the bracket is so fixed, extend horizontally longitudinally along and coextensive with upper and lower edges of said outline;

an elongate main body having means for linking a top thereof, in use, with a frame of the door to close the door, the main body also having two mutually parallel walls, each wall having an elongate groove recessed therein and coextensive with the main body, and each groove having undercut longitudinal edges shaped for slidable fit with the tongue-shaped coupling portions of the mounting bracket, so that the main body can be slidably engaged with the bracket, engaging one of the grooves in use of the main body on a left-handed door, whereas the bracket engages the other groove in use of the main body on a right-handed door; and a cover plate for covering the groove not so engaged, the cover plate having a pair of tongue-shaped coupling portions similar to those of the bracket.

2. A door closer according to claim 1, wherein each of the mounting bracket and the main body has a hole therein, and further including; a connecting member which extends through the holes in the bracket and in the main body to prevent relative sliding between the main body and the bracket in use of the main body.

3. A door closer according to claim 2, wherein the covering plate has a projection on a rear face thereof and the main body has a recess on an outside face thereof, engageable with the projection to fix the covering plate to the main body against relative sliding thereof.

4. A door closer according to claim 1, wherein the grooves of the main body are dove-tailed.

5. A door closer according to claim 1, wherein the grooves of the main body have a T-shaped cross section.

6. A door closer according to claim 1, wherein the covering plate consists of synthetic resin.

* * * * *